US005966809A

United States Patent [19]

Pierce

[11] Patent Number: 5,966,809

[45] Date of Patent: Oct. 19, 1999

[54] TUBE FINNING MACHINE AND METHOD AND PRODUCT

[75] Inventor: David Bland Pierce, Walsall, United Kingdom

[73] Assignee: Britannia Heat Transfer Limited, Coleshill

[21] Appl. No.: 08/945,665

[22] PCT Filed: May 1, 1996

[86] PCT No.: PCT/GB96/01038

§ 371 Date: Oct. 31, 1997

§ 102(e) Date: Oct. 31, 1997

[87] PCT Pub. No.: WO96/35093

PCT Pub. Date: Nov. 7, 1996

[30] Foreign Application Priority Data

May 2, 1995 [GB] United Kingdom ..... 9508921
Sep. 13, 1995 [GB] United Kingdom ..... 9518663

[51] Int. Cl.[6] ..... B21D 53/02

[52] U.S. Cl. ..... 29/890.047; 165/182

[58] Field of Search ..... 165/182, 183; 29/890.047

[56] References Cited

U.S. PATENT DOCUMENTS

| | | | |
|---|---|---|---|
| 2,278,155 | 3/1942 | Steenstrup | 29/890.047 |
| 3,089,226 | 5/1963 | Szots et al. | 29/890.047 |
| 3,457,620 | 7/1969 | Ares | 29/890.047 |
| 3,482,299 | 12/1969 | Davidson et al. | 29/890.047 |
| 3,526,958 | 9/1970 | Grant | 165/182 |
| 3,643,312 | 2/1972 | Shriver | 165/182 |
| 4,494,288 | 1/1985 | Nagai et al. | 29/890.047 |
| 4,815,185 | 3/1989 | Gray | 29/890.047 |
| 4,835,828 | 6/1989 | York et al. | 29/890.047 |
| 4,839,950 | 6/1989 | Stroup | 29/890.047 |
| 4,876,779 | 10/1989 | Gray | 29/890.047 |

*Primary Examiner*—James C. Yeung
*Assistant Examiner*—Terrell McKinnon
*Attorney, Agent, or Firm*—Albert O. Cota

[57] ABSTRACT

A heat exchange unit for a heat exchanger which includes a first tube with an outer surface and extended surface members located axially along the outer surface. Each member has a tube engagement surface and are axially Positioned. There is also taught a heat exchange fin block having a heat exchange unit with a second tube interconnected to the first tube by the extended surface members, wherein the extended surface members being tube fins at predetermined axial spacings. A tube finning machine is disclosed which includes a base with clamping means mounted thereon, carrier means movable relative to the base, and drive means for moving the carrier means. The clamping means clamps a portion of the first tube, and the carrier means transports at least one fin to an axially predetermined position adjacent the portion. Also disclosed is a method of finning a tube which includes supporting the tube to include a free end, positioning a carrier means at a start position, presenting a fin to the carrier means with pre-set angular orientation, locating the fin upon the carrier means while the carrier means is at the start position, moving the carrier means to drive the fin over the free end of the tube and thereafter a predetermined distance along the tube, returning the carrier means without the fin to the start position, and repeating the cycle by presenting another fin to the carrier means with the angular orientation but with the carrier means having a smaller predetermined distance.

7 Claims, 4 Drawing Sheets

TUBE FINNING MACHINE AND METHOD AND PRODUCT

This invention relates to a tube finning machine and method and product.

The invention has particular utility in relation to a machine and method for producing a fin block by simultaneously finning several tubes with a common-fin; it also has utility in relation to simultaneously finning several tubes with independent fins. In both of these, there is also disclosed means for finning tubes of significant length.

The invention also allows finning of non-metallic tubes with non-deformable fins.

BACKGROUND OF THE INVENTION

Often it is necessary to cool a working fluid, and it is known for this purpose to use a heat exchanger. Heat exchangers usually comprise one or more metallic tubes suspended between two tube plates. The working fluid to be cooled, which may for example be water or oil, flows through the tubes, whilst the coolant passes around and between those tubes, the working fluid giving up its latent heat to the tubes and thus to the coolant.

The effective surface area of a tube can be enlarged in order to increase the heat transfer, as by the addition of one or more annular fins in thermal contact with the outer surface of the tube. Such finned tubes are particularly useful if the coolant has a low viscosity, and if the coolant is a gas, such as air.

If the tubes are to withstand the internal pressure of the fluid to be cooled, the addition of the fins should not reduce or significantly reduce the tube bursting strength. If the fins are to increase the heat transfer they should not inhibit the flow of coolant, and preferably should encourage turbulent coolant flow.

The tubes to be used for heat exchangers should meet certain standards (in the UK for instance British Standard 2871 Part 3), these standards being relevant also for those tubes which are formed by extrusion to provide selected internal formations chosen to enhance internal turbulent flow i.e. to avoid laminar or stratified flow of the liquid to be cooled; desirably the tube finning should not reduce those respective standards e.g. of tube wall thickness and thus of strength, or of tube uniformity and fin engagement and thus of heat transfer to the fins.

The fins should be positioned on the tube so as to encourage maximum heat transfer to the coolant, which will not occur if the fin spacing is irregular, or if the fin angles are irregular (with an annular gap of varying axial length between adjacent fins).

If the tube walls need to be thinned to accept the fins, one or more of the tubes may burst in service and need to be plugged; if the fins are irregularly spaced and/or angled the performance of the heat exchanger will be reduced.

It is a known design criterion when constructing a matrix or array of finned tubes for a heat exchanger both to arrange the tubes as close as possible to each other (to reduce the size of the heat exchanger), and to have a maximum area of thermal transfer between the working fluid and the coolant (to maximise the possible heat exchange). When utilising tubes fitted with the known annular fins in such an array, the spacing between the tubes will be limited by the outer diameter of the fin(s); if as is usual the fins have circular outer peripheries there are areas between adjacent tubes which do not contribute to heat transfer, and a finning method and machine permitting fins to be fitted which can utilise these areas is desirable.

The performance of a heat exchanger in part depends upon the number of fins fitted to a tube, and to the total number of fins i.e. to the aggregate extended area available for heat exchange as well as to the positioning and disposition of those fins.

DESCRIPTION OF THE PRIOR ART

A finned tube comprising separate inter-engaging annular fin elements, each with a segmented collar to grip the outer surface of a tube, is disclosed in GB 2,110,811. Each collar preferably has a slightly tapering profile such that adjacent fin elements can nest together; under an axial compressive force applied at the end of the assembly operation, the sleeve portions of the elements are contracted radially inwards and become wedged together.

A disadvantage of this known fin is that the fin spacing and thus the number of fins mounted onto a tube is dependent upon collar length, which usually will vary randomly from fin to fin (because of manufacturing tolerances). Furthermore, because the fin positions are determined by the previously fitted fin, the fin spacings along the tube will be nonuniform due to a build up of tolerances, and with irregular heat transfer along the tube length. The angle adopted by the flange portion of a fin will also depend on the interengagement between its collar and that of the previous fin, and if the flange portions of successive fins are not parallel the working fluid will not circulate uniformly between the fins.

In this known arrangement the fins should be mounted so that the segments of the collar align; however, during fitting of the fins, rotation about the tube of one fin relative to the other fins (as may occur when manually feeding a fin along the tube prior to engagement with an already-fitted fin) is difficult to resist or prevent, so that unwanted misalignment of the segments, and thus reduced heat transfer for this reason also, may occur. Also, the fins can be distorted during feeding along the tube.

The fins of this disclosure have a circular outer periphery. However it is known to fit separate "acircular" fins, e.g. fins with a square or rectangular outer periphery, upon a tube. The fins when mounted on tubes in an array will occupy a greater area between adjacent tubes than fins with a circular outer periphery. However, the additional control means used to ensure that all of the fins on a tube are correctly aligned one to another (so that the fins on a tube will fit closely with the fins on adjacent tubes) often makes such fins uneconomic to fit, so that such a design is not greatly utilised in practice.

In another design seeking to overcome the disadvantage of the wasted heat-exchange area caused by the use of circular periphery fins, it is known to replace the separate fins of adjacent tubes by axially-spaced "common-fins" i.e. fins which interconnect several tubes. Typically, a common-fin takes the form of an extended plate having several apertures, each aperture being adapted to receive a respective tube, the plate-like common-fin being in simultaneous thermal contact with several tubes, and being adapted to transfer the heat from all of the tubes across the full area therebetween. An array of tubes to which are mounted a plurality of multi-apertured common-fins is referred to herein as a "fin block", though in other documents it is also referred to as a "coil block" or "block fin".

It will be understood that in a fin block, the or each fin is continuous between and around each tube in the block, so that a minimum of heat transfer area is wasted. It will be further understood that the tubes in each block are fixed relative to the other tubes of that block by the prefitted plate-like common-fins.

A known further advantage of such assembled fin block is its relative ease of fitment into a heat exchanger. Thus, for a heat exchanger requiring two hundred separate finned tubes for instance, each of the two hundred tubes must be fitted to both tube plates, and perhaps also to separate support plates as may be required for longer tubes. However, if a fin block is prepared having twenty tubes, then only ten such blocks are required to be handled and fitted.

In a known method of manufacturing a fin block, a stack of common-fins is arranged, adjacent fins being axially spaced by a distance to suit the requirements of a particular heat exchanger; each common-fin has several apertures, the apertures corresponding in pattern to the required tube arrangement (typically a triangular arrangement for heat exchanger applications). The apertures are slightly larger than the outside diameter of the tubes, and the common-fins are held with their respective apertures aligned. The tubes are then individually passed through the apertures, and when in position a "bullet" is pulled through each tube, to expand the tube wall into mechanical contact with the respective fin apertures.

This method is not suitable for extruded tubes having internal formations e.g. for promoting turbulent flow of the liquid to be cooled.

A disadvantage of this known bulleting method is that the wall thickness of the tubes is limited by the need for the wall to be stretched by the bulleting operation, so that thinner walled tubes have to be used than might otherwise be desired; for example, in practice for a stainless steel tube with an outer diameter of 0.75" (19.05 mm) it is rare for tube thicker that 22 Gauge ("Standard Wire Gauge") to be bulleted. A second disadvantage is that the bulleting operation introduces stress into the tubes, and can change the grain structure; the stress is typically not removed by heat treatment since the heat treatment would act also to soften the fins and reduce the thermal contact between the fins and tubes, i.e. the stress induced by the bulleting operation typically remains in the tube and thus in the heat exchanger as an unwanted side effect of this method of production. A third disadvantage is that the material specification of the tubes can be altered by the bulleting operation; for example, if the heat exchanger user specified that annealed tubes should be used, the bulleting operation can in some circumstances alter the annealed material into a non-annealed hardened state. A fourth disadvantage is that the tube must be of deformable material, so limiting the material which can be used.

Bulleting also results in non-parallel finning. As the bullet is pulled through the tube, the tube wall can form an angled "front" which moves down the tube immediately ahead of the bullet, as a "ripple"; adjacent fins subject to the "ripple" are likely either to be moved along the tube, or to adopt different angles relative to the tube, resulting on occasion with parts of adjacent fins touching and with other parts spaced by a greater distance than intended. The expansion caused by the bullet is such that once the bullet has passed a fin, the position of the fin cannot subsequently be corrected or altered.

Usually when "rippling" is seen to be occurring during tube finning the bullet has nevertheless to be fully drawn through the tube so that it can be reused, even though the manufacturer recognises that the resulting finned tube is likely to be rejected as unsuitable for heat exchanger use. Also, if a set of tubes is finned whilst in position in a heat exchanger array, any fin displacement which occurs upon internal and thus non-visible tubes cannot be observed, so that the resulting loss of heat exchanger performance might not be realised until the exchanger is in service.

A machine for applying extended surface "add-on" elements to the tubes of a heat exchange device is disclosed in GB 527,615. That machine is not however suited to fitting fins to the tube at predetermined axial positions; nor is it suited to loading several tubes simultaneously, nor to supporting tubes (for fin loading) of an extended length and which are likely to bend or sag at the free end i.e. when mounted in cantilever at the other end, nor to transferring fins to a carrier ready for fin loading onto one or more tubes, nor to maintaining the angle of the plate during fitting at a predetermined value i.e. the same or similar value to that of the other fins.

The known machines and methods are not suited to the finning of corrosion resistant non-metallic tubes with non-metallic fins which are substantially non-deformable, and which might fracture or crack if positioned by the traditional force-fit "mutual impact" methods.

STATEMENT OF THE INVENTION

The present invention is directed to a finning machine and method and product which reduces or avoids the disadvantages described above. Whilst the machine and method has particular advantages when used to manufacture fin block, we do not limit its use to such a product. Furthermore, although the machine has particular utility as for feeding the fins to a predetermined position, the facility for fitting fins with their plate portions parallel (albeit at irregular fin spacing determined by the collar interengagement) might be acceptable to some users.

The invention will be more particularly set out in the accompanying claims.

Thus according to one feature of the invention we provide a heat exchange unit for a heat exchanger which includes a first tube with an outer surface and extended surface members located at axially spaced positions along the outer surface, the members each having a tube engagement surface, characterised in that the members are each located at a respective predetermined axial position.

The members can each have an integral collar, the collar of at least one fin can be interlocked with the collars of the two adjacent fins. The extended surface members and tube can be of the same or of different material; the members can be spaced apart.

We can also provide a fin block which includes a heat exchange unit as above but with a second tube interconnected to the first tube by the extended surface members, the extended surface members being axially spaced tube fins.

As a further feature of the invention we provide a tube finning machine for the manufacture of a heat exchange unit which includes a base, clamping means mounted to the base, carrier means movable relative to the base, and drive means for moving the carrier means characterised in that the clamping means can clamp a portion of the first tube, and in that the carrier means can transport at least one fin to an axially predetermined position adjacent said portion.

Usefully the drive means is a linear motor having first and second windings, in that the first winding of the linear motor is fixed to the base and the second winding slidably mounted to the base, and in that the carrier means is connected to the second winding. Suitably the first winding is a "squirrel cage winding", and the second winding is a multi-phase winding, preferably a three-phase winding. A measuring means can be provided to determine the position of the carrier means relative to the base, measuring means being connected to control means for the drive means whereby to effect movement of the carrier to a pre-determined position relative to the base.

We can also provide a tube finning machine having clamping means which can clamp simultaneously a number of tubes in preselected array, by at least one tube support member which is mounted so as to be pivotable relative to the base and having a first position in which it can support a part of each respective tube and a second position in which it cannot support the said part, the support member being moved between its first and second positions by movement of the carrier means, by transfer means carried by the machine which present at least one fin at a selected position relative to the carrier means, and by holding means to support each presented fin in abutment with the carrier means.

We also teach a method of finning a tube characterised by the steps of supporting the tube so that it has a free end, positioning a carrier means at a start position, presenting a fin to the carrier means with a pre-set angular orientation, locating the fin upon the carrier means whilst the carrier means is at the start position, moving the carrier means so as to drive the fin over the free end of the tube and thereafter a predetermined distance along the tube, returning the carrier means without the fin to said start position, and repeating the cycle by presenting another fin to said carrier means with the pre-set angular orientation but with the carrier means having a smaller predetermined distance.

Also, for finning simultaneously a plurality of tubes to form a fin block we teach the steps of: {i} supporting a plurality of tubes in substantially fixed relative positions, the supported tubes each having a free end, {ii} holding a fin upon carrier means adjacent the free ends of the tubes, the fin having apertures corresponding to the positions of the tubes, {iii} moving the fin onto the tubes, and {iv} returning the carrier means for the location of another fin.

Preferably, the carrier means has a number of apertures equal to or greater than the number of tubes in the array, each aperture being of a size slightly larger than the outside diameter of the tubes.

Desirably for a fin block, the fin is plate-like, and has a number of apertures equal to the number of tubes in the array, the apertures (e.g. in metallic or other deformable fin materials) being slightly smaller than the outside diameter of the tubes so that each fin is a force fit onto the tubes, where it remains held by its friction fit against axial or rotational movement, but at an angle predetermined by its engagement with the carrier means. Desirably also, some or all of the apertures have a collar adapted to space the fin from, and engage the fin with, an adjacent fin. The fins can be corrugated, so that adjacent fins form a part-sinusoidal path transverse to the direction of flow of coolant impinging against the tube whereby to enhance turbulent coolant flow for improved heat transfer.

Usefully the fin includes an integral collar, with the collar heel adjacent the fin of larger diameter than the tube whilst the free end of the collar (the collar toe) is of smaller diameter i.e. the collar is generally frusto-conical prior to assembly on the tube.

The carrier means includes a carrier plate having an abutment surface conforming to the fin plate surface, so as to predetermine the plate angle, independently of that of the collar if present. The abutment surface usefully has small openings connected to a vacuum source to permit a suction grip of the fin to the abutment surface whilst the carrier dwells at the start position. When during initial carrier movement the fin has passed over the free end of the tube, the toe of the collar is in an interference fit with the tube. When the fin is driven along the tube against the frictional resistance from the collar and tube contact the fin "drags", whereupon the fin plate backs tightly up against the abutment surface and adopts the angle of the abutment surface, so ensuring that successive fins are assembled parallel one to another. Normally, the angle of the abutment surface will be perpendicular (or substantially so) to the axis of the tubes.

The carrier plate usefully is replaceable so that fin plates of different design (e.g. fluted, or non-perpendicular to the collar) can alternatively be assembled in parallel formation with predetermined (usually equal) fin spacing, as by using a carrier plate with a respective fluted or angled abutment surface. In a suitable embodiment the abutment surface is apertured to receive the fin collar, the collar then being in the trailing condition whilst being driven along the tube so as to avoid spragging of the collar toe.

Usefully a transfer means can select a fin from a magazine carried by the machine, but the magazine can in an alternative arrangement be adjacent to but separated from the machine.

The transfer means can be arranged simultaneously to select one or more fins and if the latter either a plurality of independent fins or a common-fin (conveniently an elongated fin with its apertures in a row). One transfer means can present the selected fin to the carrier means at the orientation of selection, whilst an alternative transfer means can present the selected fin(s) at a different orientation e.g. 90° to the fin orientation in the magazine.

Because the fin orientation relative to the respective tube is set at the carrier, non-standard tubes having a non-circular outer periphery can be finned.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
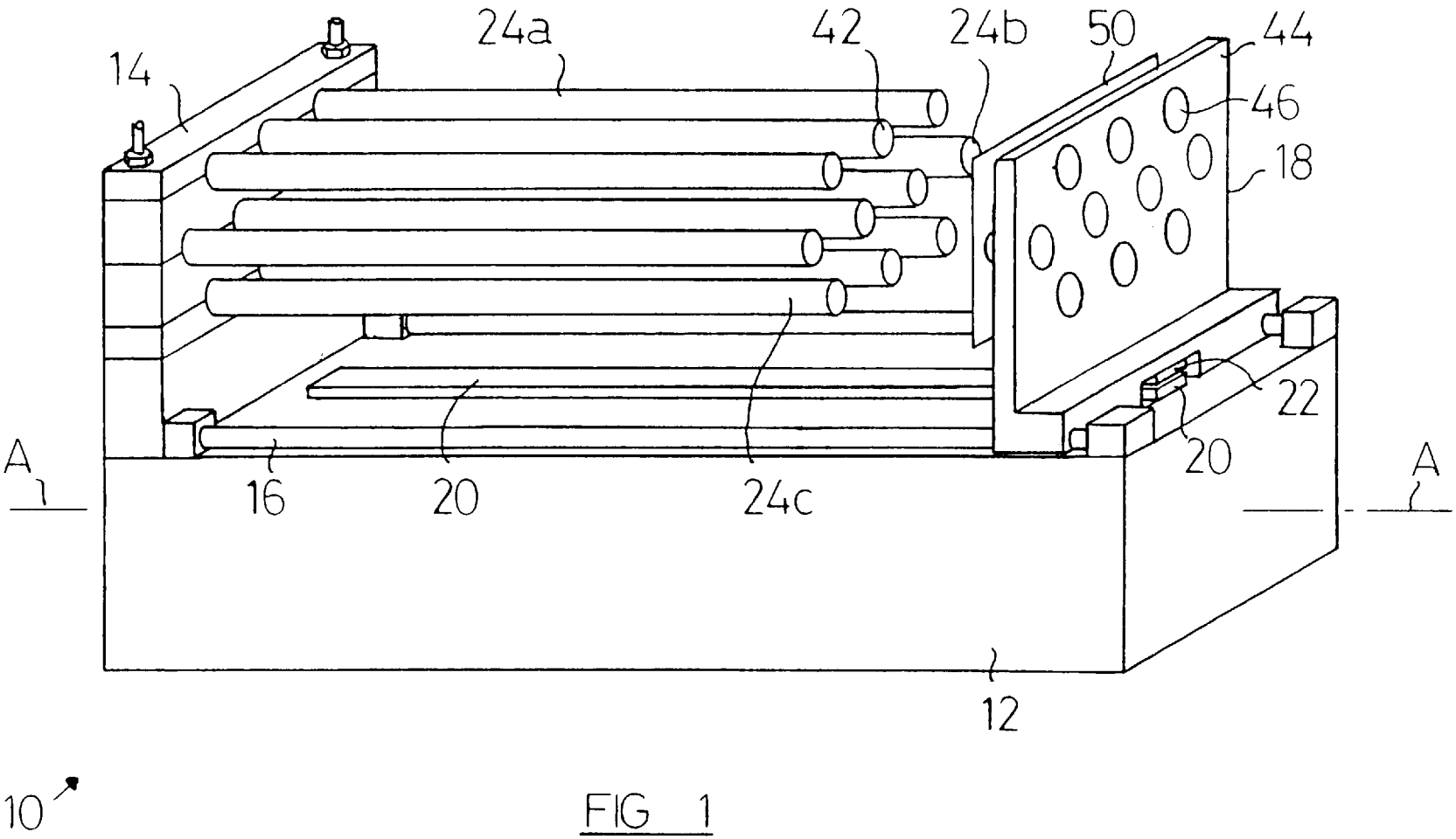
FIG. 1 is a perspective view of a finning machine according to the invention.

In this description, directional terms such as "top", "bottom", "upper", "lower" etc. refer to the orientation of the machine and its components as drawn in FIG. 1, which we foresee to be the normal orientation of use. However, we do not exclude the use of a machine with the tubes standing (or suspended) substantially vertically, and the relative directional terms can be translated to such an orientation.

The machine 10 comprises a substantially rigid base 12, at one end of which is fixedly mounted clamping means 14. The base has a pair of guide bars 16, upon which can slide carrier means 18. The drive means for moving the carrier means 18 in this embodiment is a linear motor of known design which includes a first winding 20 mounted upon the base 12 and arranged substantially parallel to the longitudinal axis A of the base 12, and a second winding 22 connected to the carrier means 18; the second winding 22 slides with the carrier means 18 closely adjacent the first winding 20. The electrical wires leading to the first and second windings are of known form, and are not shown.

An array of tubes 24*a,b,c* are each clamped at one of their ends in clamping means 14; thus, the tubes are mounted in cantilever. In this embodiment the array comprises ten tubes in three vertically-spaced rows, there being three tubes 24*a* in the top row, four tubes 24*b* in the middle row, and three tubes 24*c* in the bottom row.

Figure 2:
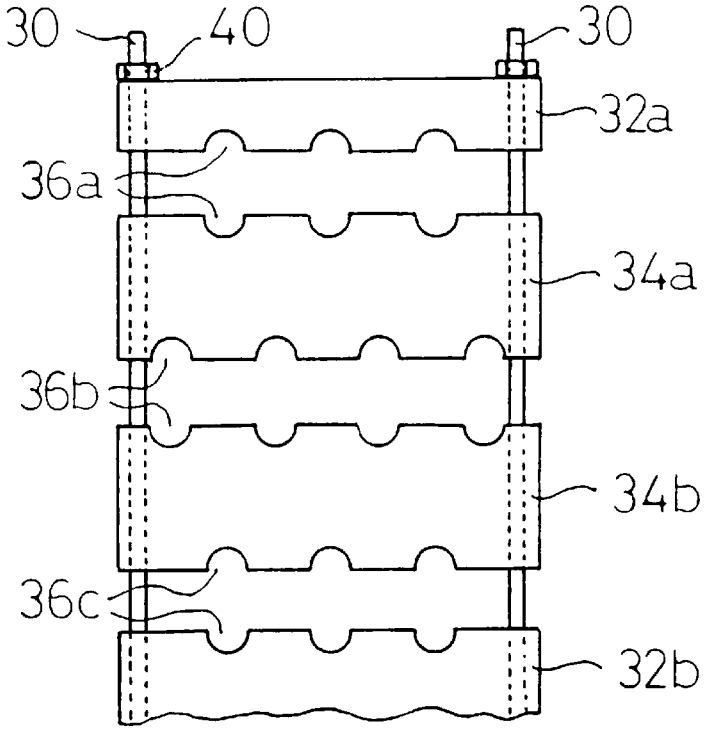
FIG. 2 is a partial left-hand end view of the finning machine of FIG. 1.

As more clearly seen in FIG. 2, in this embodiment the clamping means 14 comprises a pair of threaded bolts 30, upon which are located four clamping beams 32*a*,34*a*,34*b*, 32*b*. Beam 32*a* has three part-circular recesses 36*a* in its lower face. Beam 34*a* has three part-circular recesses 36*a* in its upper face, and four part-circular recesses 36*b* in its lower face. Clamping beam 34*b* has four part-circular recesses 36*b* in upper face, and three part-circular recesses 36*c* in its lower face. Clamping beam 32*b* has three part-circular recesses 36*a* in its upper face.

The positioning of the part-circular recesses 36*a,b*, and the arrangement of the beams 32*a,b*,34*a,b*, are such that upon bringing the clamping beams together, the recesses align to provide two rows of three substantially circular openings, with a row of four substantially circular openings therebetween, the openings being in a triangular, preferably equilateral, array.

The openings may be circular or only substantially so, but arranged so that the desired clamping load will be applied to the tubes, i.e. the user may need to impart a small amount of distortion into the tubes, or else the clamping beams may themselves slightly distort, upon full clamping load.

To locate the tubes into the clamping means 14, the beam 32*b*is mounted in position upon the bolts 30, and the ends of the three tubes 24*c* are placed in the respective recesses 36*c*. The beam 34*b* is then lowered upon the bolts 30, this beam acting to locate and partly clamp the three placed tubes 24*c*. Four further tubes 24*b* are then placed into the four recesses 36*b* of the beam 34*b* and the beam 34*a* is then lowered upon the bolts 30, locating and partly clamping the four placed tubes 24*b*. The final three tubes 24*a* are then placed into the three recesses 36*a* of beam 34*a*, and the beam 32*a* lowered onto bolts 30. Nuts 40 are used to clamp the beams 32*a,b*, 34*a,b*, together, whereupon the ends of the tubes 24*a,b,c*, are firmly located.

In one embodiment the free ends of the tubes (opposed to the ends to be clamped) are themselves temporarily supported during the clamping procedure; alternatively or additionally, the beam 34*b* may be firmly clamped to the beam 32*b*, fully to support tubes 24*c*, before tubes 24*b* or 24*a* are added, so that separate clamping means are provided for each row of tubes 24*a,b,c*.

In an alternative clamping means, the beams 32*a,b*,34*a,b* are biassed apart by compression springs, and a pneumatic ram acts on beam 32*a* to overcome the spring force and clamp the beams together; upon release of the pneumatic ram the springs urge the beams apart to a condition similar to that of FIG. 2.

Thus, the tubes 24*a,b,c*, are mounted in cantilever, with their axes substantially parallel to the axis A of the base 12. In this embodiment the tubes 24*a,b,c* are almost as long as the base, so that only a small gap exists between the free ends 42 of the tubes, and the carrying means 18 in its position of rest, as shown in FIG. 1. It will be understood that the machine base could be long enough to accommodate tubes of a length desired to be used, e.g. 6 metres or more. However, it would alternatively be possible to support very long tubes at their mid-point (i.e. to fit a sleeve around the middle of the tube, which sleeve could then be clamped as above) and then successively fin the separate halves of the tubes from each respective end. Following the finning of such a tube, the sleeve would be left in place for use with a support plate or other partition within the heat exchanger.

Alternatively, a number of fins may be fitted at the approximate mid-point of a tube, which fins can then be used to clamp the tube whilst each "half" of the tube is separately finned.

In one embodiment for separately finning the two "halves" of long tubes, one "half" of the tubes may first be finned and then the tubes released from the clamping means, rotated through 180°, and then the other "half" be finned. In an alternative embodiment, the clamping means may be located upon a rotatable turntable, so that it is not necessary to unclamp the tubes to effect the 180° rotation. In another alternative embodiment, the separate finning of each "half" could occur simultaneously, with a first carrier means and drive means to one side of the clamping means and a second carrier means and drive means to the other side of the clamping means. An advantage of this feature of the invention is that finned tubes and fin blocks of a length equal to or greater than those using externally spirally wound strip is possible e.g. 2×6 m.

Alternatively finning of the separate halves of the tube from each respective end can be used to reduce the maximum distance by which a fin must be driven onto a tube. For example, for a 6 metre tube, and with a working speed of the drive means of 3 metres/second, it may be desirable to drive the fin no more than 3 metres onto the tube in order to avoid excess heat build up in the fin caused by friction between the fin and tube, which excess heat build up may affect the eventual thermal contact between the fin and tube.

Two or more drive means (e.g. linear motors) can be mounted in series or in parallel to the carrier means, to provide a greater driving force, for simultaneous finning of a larger tube array.

The carrying means 18 has a carrying plate 44 which has ten apertures corresponding in position to the tubes in the array. The apertures 46 in the carrying plate are slightly larger than the outer diameter of the tubes, so that there is little or no contact, and thus little or no friction, between the tubes and the carrying plate.

In this embodiment the machine is to be used for making a fin block, so that a single plate-like fin 50, having ten apertures corresponding to the tubes 24*a,b,c* in the array is to be driven onto the tubes. The carrying plate 44 has holding means (not seen) for the fin. The holding means may be mechanical, e.g. clips which can grip the fin between or to the side of the apertures), a pivoted plate which can sandwich a part of the fin between itself and the carrying plate (albeit requiring a depth of fin to one side of the apertures), or catches; the holding means could for suitable materials be magnetic. In an alternative and preferred embodiment, usable alone or in conjunction with a mechanical means, the fin is held onto the carrying plate by pressure, the carrying plate being connected to a pump whereby a reduced pressure is caused to exist at openings in the plate, the openings being covered by the fin, so that the suction effect causes the fin to remain in contact with the plate. In this alternative embodiment, the pump may be turned off as soon as the carrying means passes the free ends 42 of the tubes, since the fin will then be located by the tubes, with the frictional, collar drag causing the fin plate to back against rather than needing to be held back against the carrier plate.

Figure 3:
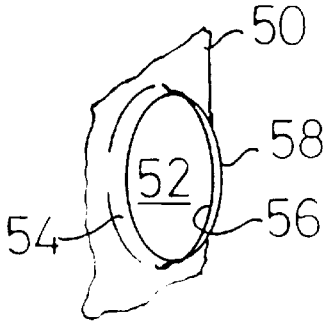
FIG. 3 is a perspective view of part of a plate-like fin for use with the machine of FIG. 1.

As shown in FIG. 3, the apertures 52 of the fin 50 each have a collar or lip 54. The collar is sized so that the heel 56 is slightly larger than, and the toe 58 is slightly smaller than, the outside diameter of the tube. Thus, the fin is a friction fit onto the tubes, the toe 58 of a given aperture being caused to stretch slightly to accommodate the respective tube 24*a, b,c*. When fitted to the tubes, the heel of each aperture will be spaced slightly from the tube, and will accommodate the toe of the adjacent fin. In this way, adjacent fins are caused to engage and interlock, the cooperating fins adding strength to the fin block. In addition, the collars can act to space the fins apart. Thus, with such fins, the machine may be set to cease driving a fin onto the tube when the force required to continue movement exceeds a certain limit, and the limit will be determined by the engagement between the toe(s) of one fin with heel(s) of the adjacent fin.

Furthermore, the collars act to prevent contact of the coolant with the tube wall, which may otherwise be of concern if the coolant, or a contaminant contained therein, is potentially corrosive to the tube wall.

In an alternative and preferred embodiment, measurement means, such as a linear transducer or potentiometer for example, can be used to determine the position of the carrier means relative to the base, and control means can be used in combination with the drive means to place successive fins at predetermined positions on the tubes, e.g. successive fins may be placed 100 cm, 99.8 cm, 99.6 cm etc. along the tubes. This embodiment has an advantage both when the fin spacing is relatively large, i.e. when adjacent fins are mounted not to engage, as may be required if the coolant is particularly viscous, for example, and when the collar length of the fin(s) can be strictly controlled, so that a certain fin spacing ensures the required toe/heel engagement between adjacent fins. In a known linear motor having a transducer as position sensor, the position of the motor can be controlled to a claimed accuracy of 5 $\mu$m.

Figure 4:
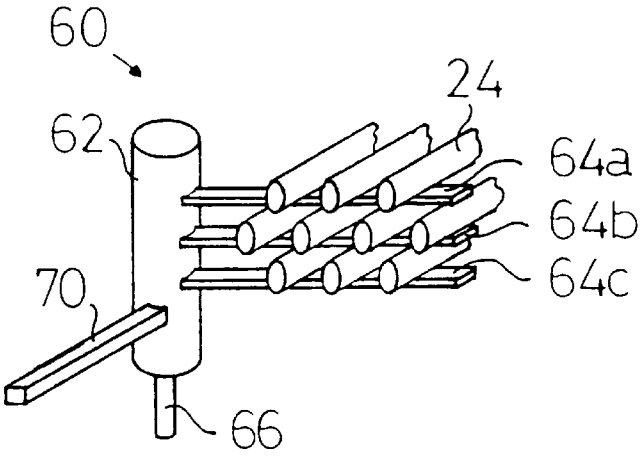
FIG. 4 is a perspective view of a support member for use with the machine of FIG. 1.

For particularly long tubes, we foresee that additional support means will be required, i.e. the tubes are likely to bend to such a degree that the carrier means may foul the free ends of the tubes, even if those free ends are fitted with a centralising cone. An additional support member 60 is shown in FIG. 4.

The support member 60 has a shaft 62, upon which are mounted three arms 64*a*,64*b*,64*c*. The arms 64*a,b,c*, are spaced apart by a distance equal to the spacing between the rows of tubes 24*a,b,c*, and the arms are designed to fit between those rows of tubes. The support member 60 has a peg 66, which may be located in a hole in the machine base 12; when so located, the shaft 60 will be substantially vertical, and the support member will be relatively free to rotate about the peg 66. A control arm 70, which projects perpendicularly to the arms 64*a,b,c* in plan, is also carried by the shaft 62.

In use, the support member 60 has a first position (as shown) in which the arms 64*a,b,c*, lie underneath the respective rows of tubes 24*a,b,c*, the weight of the tubes being supported by the arms so that any tendency of the tubes to bend under the influence of gravity is resisted. As the carrier means passes the support member, the arms 64*a,b,c*, are pushed out of the way (i.e. the support member 60 is rotated through approximately 90° about the peg 66 to its second position, the tubes being supported at this time by the carrying means and the fin. In the second position, the control arm 70 lies in the path of the carrier means, so that the return of the carrier means causes the support member 60 to rotate back to its first position.

The base 12 includes stop means (not shown) to limit the rotation of the support member between its first and second positions; in an alternative embodiment resilient bias means can be used to ensure that the support member remains in one or other of its first and second positions and does not rotate unless moved by the carrier means.

Several support members 60 may be provided at spaced intervals along the base, as required to support tubes of a particular length.

Figure 5:
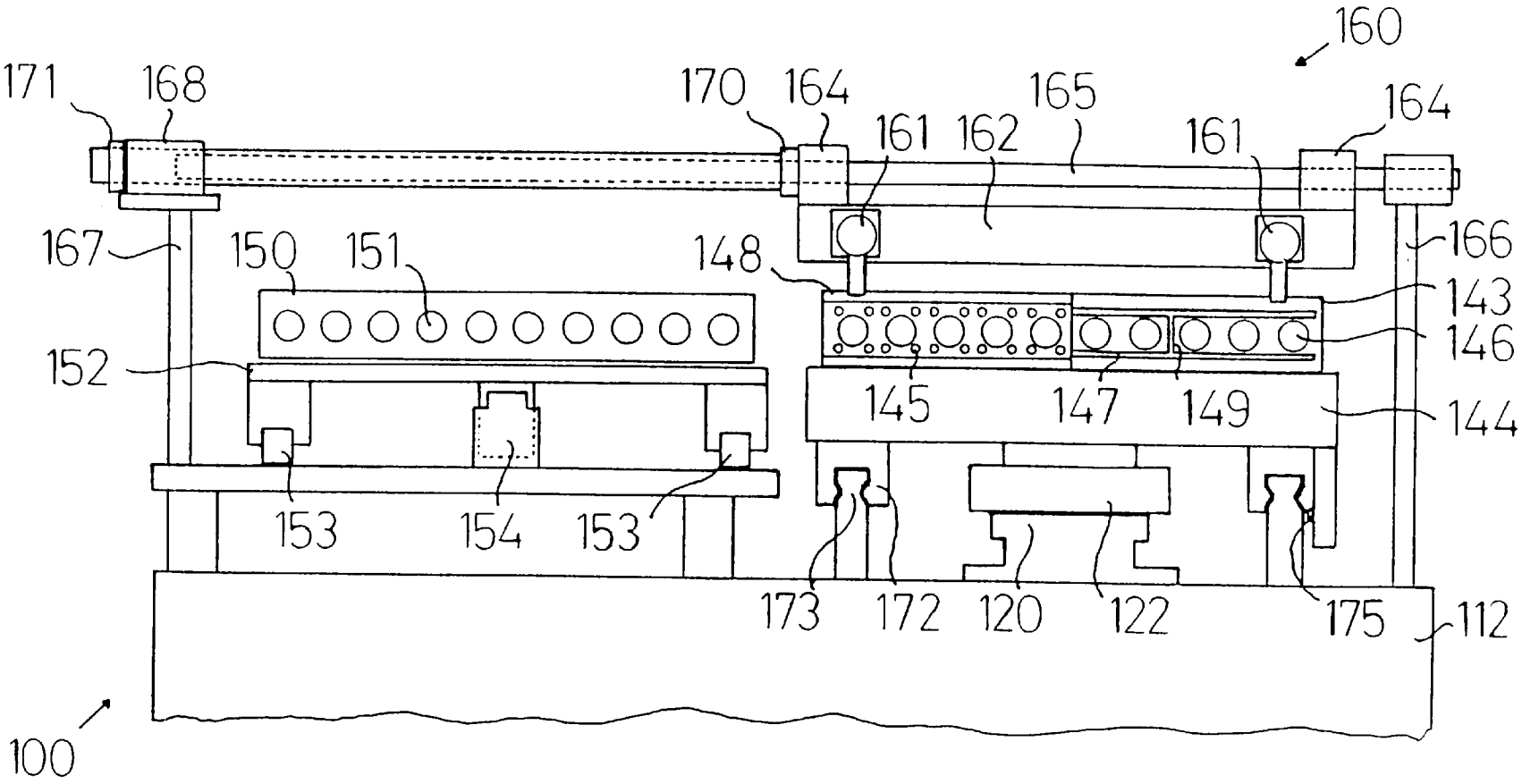
FIG. 5 is a partial end view of a carrier means, and associated fin magazine and transfer means, the carrier being partially double-sectioned.

For a finning machine according to FIG. 5, wherein the tubes. are arranged in a single row, the support means can be a single bar. This bar could rotate in a similar fashion to the support member 60 of FIG. 4, or it could rise and fall beneath the tubes (out of the path of movement of the carrier means). If the support means rises from beneath the tubes, it can have part-circular recesses which also act to reduce or prevent sideways movement of the tubes.

The height of the support means can be variable, so as to support initially unfinned, but later finned, sections of the tube.

It will be understood that the machine can alternatively be used to mount separate fins upon several tubes simultaneously. Also, the matrix or array of tubes used can be chosen largely to suit the customer or user; the number of tubes which may be finned simultaneously, or the number of tubes in the fin block, being limited only by the power of the machine necessary to overcome the combined friction between the fin(s) and the tubes. The number and relative positions on the tubes in the array can be altered by changing the form and size of the clamping beams, and correspondingly changing the form of the carrying plate.

In the embodiment of FIG. 5, the machine 100 includes carrier means 144, in this embodiment with ten in-line apertures 146 to receive the collars of either ten separate fins or a single plate-like fin 150. Each aperture 146 is closely surrounded by four ports 145 leading to upper and lower vacuum manifolds 147 connected by equalising passageway 149. The apertures 146 are in this embodiment in a substantially flat carrier plate 143, the plate however having an upper and lower recess, the upper recess 148 permitting the operation of the transfer means (as more fully described below).

In one alternative embodiment the forward surface of the carrier plate 143 is non-planar e.g. corrugated or fluted, to conform to corrugated or fluted fins; the fins might thus be mounted on the tube(s) by the machine with a specified angular orientation i.e. with fluting parallel to the fluting of the adjacent fins whereby to maintain flow passageways of constant width for the coolant impinging on the tube, but with the fluting transverse or substantially so to that flow so as to enhance flow turbulence, for improved heat transfer. In another embodiment the recesses are omitted so that all of the front surface of the carrier is in a single plane. In a preferred embodiment the forward surface is provided by a plate affixed over the vacuum manifolds and which plate is replaceable by another plate with a different aperture sizing and spacing so that other arrangements of tubes can be finned with the machine.

Secured to the underside of the carrier means 144 (as by bolts, not shown) is the primary winding 122 of the linear electric motor. The secondary winding 120 of the linear motor is mounted on the machine base 112. Appropriate energisation of the windings 120,122 causes the carrier to traverse forwardly or backwardly i.e. outwardly or inwardly of the paper.

In this embodiment the carrier means 144 is to be loaded with plate-like fin 150 adapted to provide an extended surface for ten in-line tubes. Several fins 150 are assembled on magazine 152, by hand or by an ancillary device (not shown) separate from the finning machine. Thus, one fin 150 is located behind another with the fins axially spaced apart and with the collars rearwardly facing. The magazine 152 can have a slotted floor and also slotted left hand wall so as to maintain the fins in their respective upright axially-spaced condition, but has an open top and right hand wall for the purpose described below.

The fin 150 is substantially flat, i.e. only the collars surrounding each aperture 151 project therefrom. However, in another embodiment the fin has one or more ribs to either side of the apertures (in addition to or forming the fluting as described above), to provide strength and to help maintain the straightness of the fin prior to its assembly onto the tubes. It will be understood however, that the ribs will lie outside the region to be engaged with the ports 145, so as not to affect the vacuum retention of the fin on the carrier plate.

The magazine 152 can be indexed forwardly on linear guides 153 by the ball screw and stepper motor 154. In an alternative embodiment the magazine is stationary but with the fins being resiliently biassed forwardly, being kept apart by temporary spacers, or only by their collars.

The transfer means 160 comprises two air chucks 161 mounted on chuck plate 162 which is itself mounted by bearing blocks 164 on a pair of traverse bars 165 (only one of which can be seen in this figure). The bars 165 are of stainless steel supported at opposite ends by stanchions 166,167.

Chuck plate 162 can be moved to a position above magazine 152. This movement is effected by head 168, which in this embodiment houses a pneumatic motor so as to slide chuck plate 162 back and forth along bars 165 between leftwards movement stop 170 and rightwards movement stop 171.

The air chucks 161 each have two fingers which in the leftwards end position of chuck plate 162 can be closed to grip a respective end of the forwardmost common-fin. When the chuck plate 162 has been moved to its rightwards end position (as shown in FIG. 5) the fin 150 will overlie the carrier plate 143. The fin 150 in this position fully or substantially obscures the ports 145, so that as the vacuum pump is activated the fin 150 is held upon the carrier plate. The air chucks 161 can then release the fin 150 (one finger of each chuck occupying a part of the recess 148). The air chucks 161 carry magnetic sensors to detect when the fingers of the chuck have opened and/or closed, in known fashion.

In a first alternative embodiment more than two air chucks are mounted on plate 162. In a second alternative embodiment, suitable for gripping a plurality of individual (non-connected) fins from the magazine, there are ten air chucks, or for aligned individual fins one air chuck but with fingers which laterally extend across the width of ten fins.

In a third alternative embodiment the fingers are pivotable rearwardly so that each fin collar may be swung into an aperture 146, to be then held by the vacuum at ports 145. In a fourth alternative embodiment the air chucks hold the common-fin (or individual fins) in front of the carrier plate 143, and the fin collars enter the apertures 146 as the carrier plate is moved axially forwardly i.e. during the first part of the tube finning movement.

In the embodiment shown the air chucks 161 are pivotable upon their respective mountings about an axis perpendicular to the plane of the paper, so as to move the fingers out of alignment with the carrier plate 143 prior to movement of the carrier plate.

Whilst the air chucks are being moved to the position shown in FIG. 5, the next fin 150 in the magazine 152 is being moved into a grippable position.

Movement of the carrier 144 is controlled by the linear guides 172 and runner blocks 173.

The axial distance moved by the carrier is controlled by the linear encoder 175. The collar positions and thus the fin positions along the tube will be predetermined, so that positioning errors are not cumulative i.e. each fin will be given a pre-set position relative to the tube, with the carrier movement being less for each successive fin. A gap between sets of fins can be provided if required, this facility being useful particularly for long tubes needing intermediate supplementary supports to prevent sagging and possible inter-tube contact.

In another method of using the tube finning machine, a first common-fin (or else a first set of independent fins) is pushed by the carrier and drive means onto the ends of the tubes, but the fin is not pushed along the tube into its final position. The carrier means is then withdrawn to its start position to receive a second common-fin (or second set of fins), whereupon the second fin is pushed onto the ends of the tubes, to engage with the first fin. Both first and second fins are then pushed together along the tubes to their final position.

This method takes advantage of the fact that it is the forcing of the fin onto the ends of the tubes, during which the toes of the collars are expanded over the tube ends or over a centralising cone, which requires the greatest force from the drive means, and during this movement the drive means is pushing a single fin (or single set of independent fins). However, moving the fin along the tubes requires less force, so that the drive means is able to push two interengaging fins once the collars of those fins have been expanded onto the tube ends.

It will be understood that this method results in a reduced total movement of the carrier means, and thus a possibly reduced cycle time. It might also be possible for a given drive means to move the carrier means along the tubes with three engaging common-fins (or three sets of engaging independent fins), though the interlocking engagement created between the collar toe of one fin and the collar heel of an adjacent fin might make this impractical.

Figure 6:
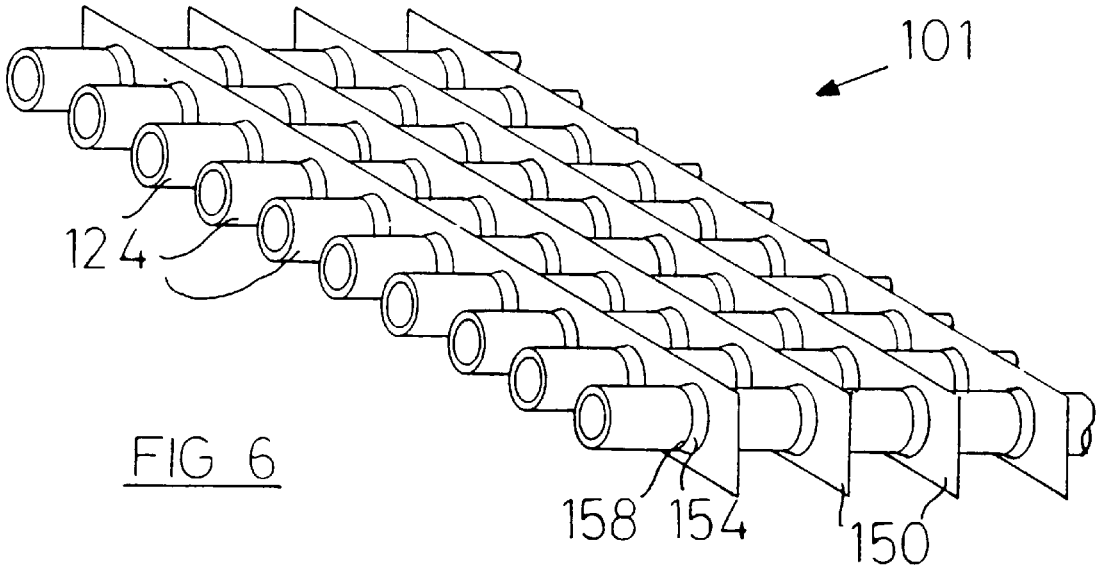
FIG. 6 is a perspective view of part of a fin block.

FIG. 6 shows part of a fin block made by the machine of FIG. 5. Fin plates 150 have been fitted to tubes 124, to form a fin block 101 with widely spaced fin plates e.g. 20 mm apart, with each fin plate at a predetermined tube axial position. In this embodiment the collars 154 are annular, and frictionally grip the tube at their trailing edge or toe 158.

In an alternative embodiment there are more than ten tubes in alignment, and then either a wider feeding and positioning machine is used, or alternatively two machines in parallel, perhaps working simultaneously, each for instance fitting a fin plate 150 with ten apertures.

It will be understood that there is no requirement for all of the tubes (or all of the fins, if these are separate), to be of the same material. Thus, the machine 100 could be used simultaneously to manufacture two fin blocks, each comprising five in-line tubes; in such a case, one fin block can have tubes and fins with a first material combination, whilst the other fin block can have tubes and fins with a second material combination. In addition, it is known that certain heat exchanger tubes are used in situations in which the fluid flowing around the tubes differs along the length of the tubes (perhaps corrosive fluid flows around only half of the length of the tubes); with our machine different fin materials (and different fin densities) can be applied along different lengths of the tube, so that it is not necessary to fin the whole tube(s) to cater for an environment encountered by only some of the fins.

Figure 7:
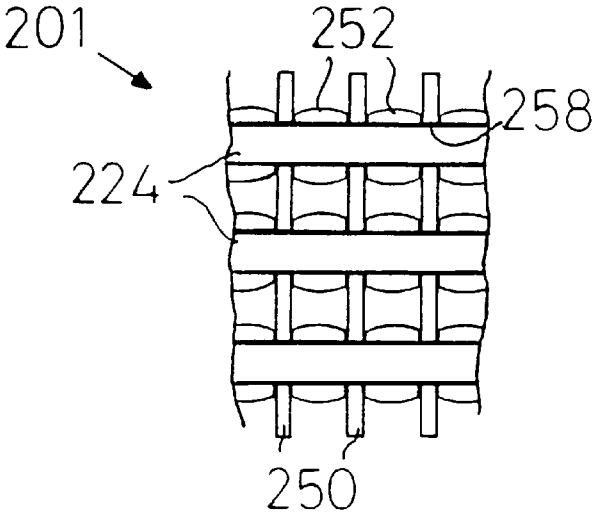
FIG. 7 is a plan view of part of an alternative embodiment of fin block with non-metallic fins.

In the embodiment of FIG. 7 the tubes 224 and extended surface members 250 are of a material liable to crack or fracture if stretched, or impacted. Such materials e.g. silicon carbide or a ceramic might however be desirable in a heat exchanger because of their ability to withstand high temperatures and particularly corrosive fluids (e.g. hot hydrogen fluoride gas). Thus fins 250 are in the form of flat apertured plates (i.e. with no collar). Each fin 250 has three circular apertures corresponding to the position of the three tubes 224 in the fin block 201; the size (e.g. diameter) of the apertures is equal to or very slightly greater than the size (e.g. outer diameter) of the tube so that the fin has a tube engagement surface 258 and is a sliding fit thereon (in an alternative embodiment the fin is a loose fit on the tube(s).

Between each pair of fins 250 is a semi-solid spacer 252, of wax or the like, which can be deformed as the second fin 250 is fed into position, and which temporarily holds the second fin in its predetermined position on the tube. When all of the fins have been slid onto the tubes, the assembled fin block is "fired" (to fuse the fins and tubes together), and though the spacers 252 can be of a non-fusible material preferably they will be vapourised so as to increase the area subsequently available for heat transfer.

In an alternative embodiment the spacer can be made up of separate volumes, perhaps sprayed on to the fin as the fin is about to be or is being fed along the tube (or for fin block along the tubes, and if not vapourised during firing can set to form axial columns joining adjacent fins and promoting turbulent flow of coolant between the fins; or in a more elaborate arrangement the semi-solid spacers are sprayed onto the tube immediately ahead of the predetermined fin position.

I claim:

1. A tube finning machine for the manufacture of a heat exchange unit comprising a tube having a longitudinal axis and an outer surface and extended surface members located at axially spaced positions along the outer surface, the members each having a tube engagement surface surrounding an aperture which has been preformed in the member, wherein the members are each located at a respective predetermined position along the longitudinal axis, the machine comprising a base, a clamping means fixedly mounted to the base, a carrier means movable relative to the base, and a drive means for moving the carrier means wherein the clamping means can clamp a portion of the tube, and wherein the carrier means can transport at least one extended surface member in the direction of the longitudinal axis of the tube to a predetermined position on the tube.

2. The heat exchange unit according to claim 1 wherein the extended surface members are spaced apart.

3. The heat exchange unit according to claim 1 wherein said tube is a first tube, wherein the unit also has a second tube with a longitudinal axis substantially parallel to the longitudinal axis of the first tube, and wherein the first and second tubes are interconnected by the extended surface members.

4. A tube finning machine for the manufacture of a heat exchange unit comprising a tube having a longitudinal axis and an outer surface and extended surface members located at axially spaced Positions along the outer surface, the members each having a tube engagement surface surrounding an aperture which has been preformed in the member, wherein the members are each located at a respective predetermined position along the longitudinal axis, the machine comprising a base, a clamping means mounted to the base, a carrier means movable relative to the base, and a drive means for moving the carrier means wherein the clamping means can clamp a portion of the tube, and wherein the carrier means can transport at least one extended surface member in the direction of the longitudinal axis of the tube to a predetermined position on the tube wherein the drive means is comprised of a linear motor having first and second windings, wherein the first winding of the linear motor is fixed to the base and the second winding is slidably mounted to the base, and wherein the carrier means is connected to the second winding.

5. The tube finning machine according to claim 4 wherein the first winding of the linear motor is a "squirrel cage winding", and the second winding is a multi-phase winding, preferably a three-phase winding, wherein a measuring means is provided to determine the position of the carrier means relative to the base, and wherein the measuring means is connected to control means for the drive means which effects movement of the carrier to a pre-determined position relative to the base.

6. A tube finning machine for the manufacture of a heat exchange unit comprising a tube having a longitudinal axis and an outer surface and extended surface members located at axially spaced positions along the outer surface, the members each having a tube engagement surface surrounding an aperture which has been preformed in the member, wherein the members are each located at a respective predetermined position along the longitudinal axis, the machine comprising a base, a clamping means fixedly mounted to the base, a carrier means movable relative to the base, and a drive means for moving the carrier means wherein the clamping means can clamp a portion of the tube, and wherein the carrier means can transport at least one extended surface member in the direction of the longitudinal axis of the tube to a predetermined position on the tube, wherein the tube finning machine further comprises a clamping means which can clamp simultaneously a number of tubes in preselected array, at least one tube support member which is mounted to be pivotable relative to the base and having a first position in which it can support a part of each respective tube and a second position in which it cannot support the said part, the support member being moved between its first and second positions by movement of the carrier means, transfer means carried by the machine which presents at least one extended surface member at a selected position relative to the carrier means, and a holding means to support each presented extended surface member in abutment with the carrier means.

7. A method of finning a tube, the tube having a longitudinal axis and an outer surface, comprising the following steps:

a) support the tube intermediate its ends, the tube thus having two free ends, characterized by finning the tube from both free ends separately, b) position a carrier means at a start position, c) present an extended surface member to the carrier means with a pre-set angular orientation, the extended surface member having a tube engagement surface surrounding a preformed aperture, d) locate the extended surface member upon the carrier means while the carrier means is at the start position, e) move the carrier means in the direction of the longitudinal axis so as to drive the extended surface member over the free end of the tub and thereafter a predetermined distance along the tube with the tube engagement surface of the extended surface member in engagement with the outer surface of the tube, f) return the carrier means without the extended surface member to said start position, and g) repeat the cycle by presenting another extended surface member to said carrier means with the pre-set angular orientation but with the carrier means having a smaller predetermined distance.

* * * * *